US005906529A

United States Patent [19]

Spais

[11] Patent Number: 5,906,529

[45] Date of Patent: May 25, 1999

[54] MULTI-WINGED BOOMERANG WITH SNAP CLUTCH

[76] Inventor: George A. Spais, 18 Marudy Dr., Apt. #3L, Clinton, N.J. 08809

[21] Appl. No.: 09/062,600

[22] Filed: Apr. 17, 1998

[51] Int. Cl.[6] ..... A63H 27/127; A63B 65/08; A63B 43/02

[52] U.S. Cl. ..... 446/36; 446/487; 473/590; 473/596

[58] Field of Search ..... 446/36, 37, 487, 446/488, 217, 378; 473/590, 596, FOR 226

[56] References Cited

U.S. PATENT DOCUMENTS

| | | | |
|---|---|---|---|
| 692,608 | 2/1902 | Bristow | 473/590 |
| 1,245,279 | 11/1917 | Shrum | 473/590 |
| 2,035,629 | 3/1936 | Wing | 446/36 |
| 2,361,988 | 11/1944 | Bonnifield | 473/590 |
| 2,380,278 | 7/1945 | Weissman | 446/36 X |
| 3,507,497 | 4/1970 | Gardner | 446/36 X |
| 3,814,431 | 6/1974 | Callahan . | |
| 4,114,307 | 9/1978 | Liebeskind | 446/487 |
| 4,216,962 | 8/1980 | Flemming . | |
| 4,377,916 | 3/1983 | Komiya | 446/487 |
| 4,817,961 | 4/1989 | Stone | 473/590 |

FOREIGN PATENT DOCUMENTS

| | | | |
|---|---|---|---|
| 2 053 010 | 2/1981 | United Kingdom | 446/488 |

*Primary Examiner*—Robert A. Hafer
*Assistant Examiner*—D. Neal Muir
*Attorney, Agent, or Firm*—Kenneth P. Glynn, Esq.

[57] ABSTRACT

A multi-winged flying toy includes a handle with a wing attachment at the upper end and a plurality of wings, each with a center hole for attachment. The attachment mechanism allows pivoting of the wings. The handle includes positioning and torque resisting formations for arranging the wings in a first position, where the wings are in alignment with one another, and a second flyable position. The handle has a centrally bored passage, and attachment shank having expanded width head, connected at its end opposite the head, to a tension mechanism located within the passage so as to maintain the shank tensed against the wings to retain the wings in first or second positions.

20 Claims, 7 Drawing Sheets

MULTI-WINGED BOOMERANG WITH SNAP CLUTCH

BACKGROUND OF THE INVENTION

1. Field of the Invention

The invention relates to a flying toy device, and more particularly, that is, hand thrown objects designed to sail up in the air and return to the thrower in a complex flight path, first, in an initial flight path in a boomerang pattern, and, second, in a final flight path in a spirally helicopter pattern.

2. Information Disclosure Statement

The most common and universally recognized boomerangs are formed of curved wood or plastic. Thrown with force and developed skill, they return to the user with significant reliability. Many improvements and designs have more recently been developed which are intended to improve the reliability of return and reduce the strength and skill required to achieve reliable flight and return. One such improvement is the multi-wing boomerang which has two or more wings centrally pivoted by a bolt and nut. The wings are positioned in their desired angular relationship and the nut tightened to frictionally secure the wings in that relationship.

On returning to earth, the boomerang sometimes inadvertently strikes an object or a person. A correctly adjusted multi-wing boomerang will collapse on striking an object or person, thereby minimizing the inertial effect, and minimizing damage or injury. In collapsing, the wings rotate at the pivot, thereby absorbing much of the striking impact. Additionally, many prior art boomerangs with multiple wings rely upon bolts and nuts which frequently are tightened to the point where excessive force is required to cause collapse, thereby increasing the probability of damage or injury to a struck object or person. They are over-tightened to better ensure against an inadvertent collapse during the throwing operation. If the pivot nut is under-tightened, the wings may collapse from the torque arising from the throwing motion thereby aborting or causing an erratic or unpredictable flight.

Additionally, these prior art multi-winged devices have somewhat unpredictable flight paths and are not aerodynamically maximized with respect to shape and weight distribution. The following are representative of the prior art:

U.S. Pat. No. 2,035,629 to Russell T. Wing describes a boomerang comprising freely rotatable blades and a car swivelled to the blades and adapted to follow the line of flight while the blades rotate. The rotatable blades project so that they serve as handles by which the device may be thrown. It also has blades which give a rotary motion on the swivelling connection between the same and car.

U.S. Pat. No. 3,814,431 to Paul J. Callahan describes a toy plastic boomerang having two interconnected wings arranged for free rotation on a vertical hollow handle with ballast therein to control the speed of descent. To propel, the user grasps one wing between the fingers so that the wings extend vertically with the handle extending laterally and throws the boomerang forward and vertically at a slight upward arc of approximately 45°.

U.S. Pat. No. 4,216,962 to Stephen J. Flemming describes a boomerang comprising a pair of elongated, airfoils coupled together at their midsections to form a cross. Mechanism is provided for releasably coupling the midportions of the airfoils for separation under a predetermined force to normally prevent relative rotation of the airfoils.

Notwithstanding the prior art, the present invention is neither taught nor rendered obvious thereby.

SUMMARY OF THE INVENTION

The present invention is a multi-winged flying toy device. It includes a handle having a predetermined shape and weight and a wing attachment at an upper end thereof. There is also a plurality of wings formed with at least two wing pieces, each wing piece having an inner end with a center hole for attachment to the handle via the wing attachment, each wing piece emanating from the inner end to an outer end, each wing piece having an inner portion in proximity to the inner end, and an outer portion in proximity to the outer end, wherein the inner portion has a predetermined cross-sectional width and the outer portion has a different predetermined cross-sectional width which is at least 1.2 times wider at its widest cross-section that the predetermined width of the inner section. The attachment mechanism includes pivoting, and the wing pieces and the handle include positioning capabilities and torque resisting capabilities for arranging the plurality of wings in a first position, which is a closed grounded position, wherein the wing pieces are in direct alignment with one another, and a second position, which is an open, flyable position, wherein the wing pieces are not in direct alignment but are arranged at positions of predetermined angles relative to one another. In one preferred embodiment, the handle has a centrally bored passage longitudinally completely therethrough, an attachment shank entering its top and extending into the bored passage, the attachment shank having expanded width head for attaching the wing pieces to the handle, and is connected at its end opposite the head to a tension mechanism located within the bored passage so as to maintain the head in a tensed position against the wing pieces and the handle so as to maintain the wing pieces in its first or second position. The attachment mechanism is releasable so as to remove tension from the wing pieces so as to permit easy movement thereof from the first to the second position and back to the first position.

BRIEF DESCRIPTION OF THE DRAWINGS

The present invention should be more fully understood when the specification herein is taken in conjunction with the drawings appended hereto wherein:

FIG. 2 is cut along lines A—A of FIG. 1;

DETAILED DESCRIPTION OF THE PRESENT INVENTION

One advantage of the present invention is to provide a multi-wing flying toy which has means provided in its construction to prevent relative wing rotation (collapse) during the normal stress of throwing, while providing positive release and relative wing rotation (collapse) on encountering the abnormal stress arising when the thrown toy strikes a person or property during the course of its flight. Another advantage of the invention is to achieve the above objective with a simple, easily manufactured construction. Another advantage of the present invention is to achieve the foregoing by providing each wing with an integral snap release clutch which interacts operatively with its adjacent wing. Another advantage of the invention is to provide a toy having a snap release clutch which provides snap release performance for two, three or four wings, thereby providing a flying toy having four, six, eight or even ten blades. Yet another advantage of the present invention derives from having an appropriate handle configuration for weight and balance, to achieve a dual flight pattern, first, as a boomerang, and second, as a helicopter. Additionally, superior wing configurations are provided by the present invention to enhance the aforesaid dual flight pattern and to increase air time.

Figure 1:
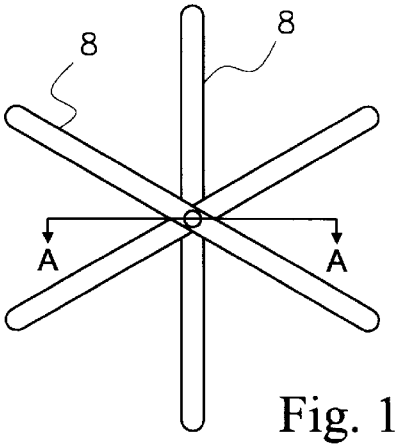
Fig. 1 PRIOR ART
FIGS. 1 and 2 show a top view and a partial side cut view of a prior art multi-winged flying toy.
Figure 2:
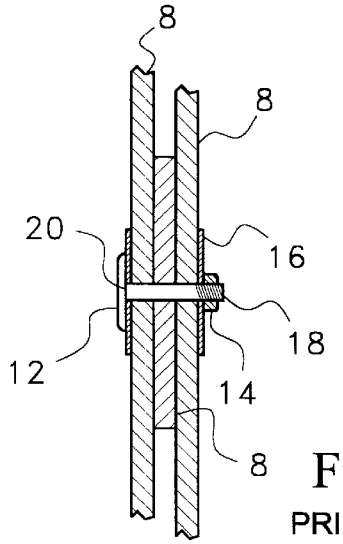
Fig. 2 PRIOR ART

In FIGS. 1 and 2 are shown views of a multi-wing boomerang well known to the art. A multiplicity of substantially identical wings 8 are formed with central holes through which bolt 20, having head 12 and nut 14 screwed onto the threaded bolt end 18, is passed. The wings are shaped with an airfoil cross-section. Washers 16 distribute the bolt tension over the face of the outermost wings to avoid damaging the wing surfaces when the nut is tightened. The user arranges the angular relationship of wings 8 as desired and then tightens nut 14 to secure the wings in their intended angular relationship, hopefully with sufficient frictional resistance to prevent unintended rotation of one wing relative to another during the throwing process. Such rotation, may disturb the intended angular relationship of the wings, and this is called a "collapse". Since throwers are most interested in securing a reliable throw and are rarely interested in the consequences of their thrown device striking people or property, they most frequently tighten nut 14, or its equivalent, as tightly as possible to best ensure against unintended collapse during the throwing operation. Even a perfectly thrown boomerang device does not always return to its thrower. Unpredictability and changes in wind and other atmospheric variables sometimes cause the path of the thrown boomerang to become unpredictable. When a prior art multi-wing boomerang device, having been tightened excessively and thrown with force, strikes a person, it does not collapse and all its energy is transmitted to the strike, thereby frequently causing injury to the person struck. When such an over-tightened thrown boomerang device strikes a rigid object, most frequently the boomerang device is damaged. Should the boomerang device strike a fragile object, most frequently, the object struck is damaged. Automobiles are among the most frequent fragile objects struck, repairs for broken windows or scratched or dented roofs costing hundreds, if not thousands, of dollars.

Figure 3:
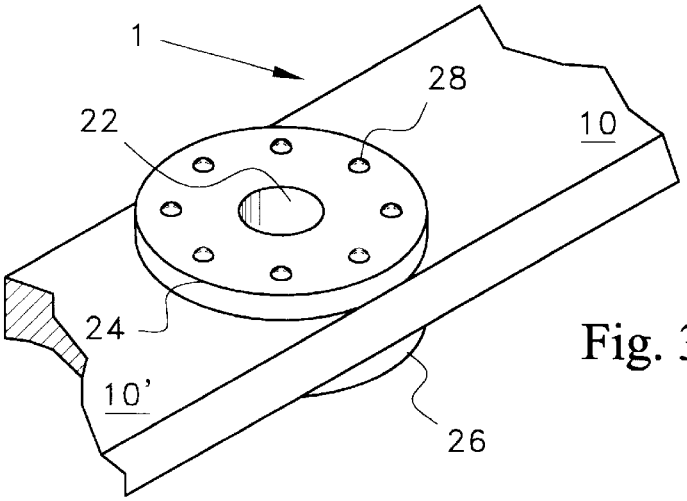
FIGS. 3 and 4 are oblique views of both sides of the central portion of a wing element of the present invention showing one form of the snap clutch formed into a raised hub.
Figure 4:
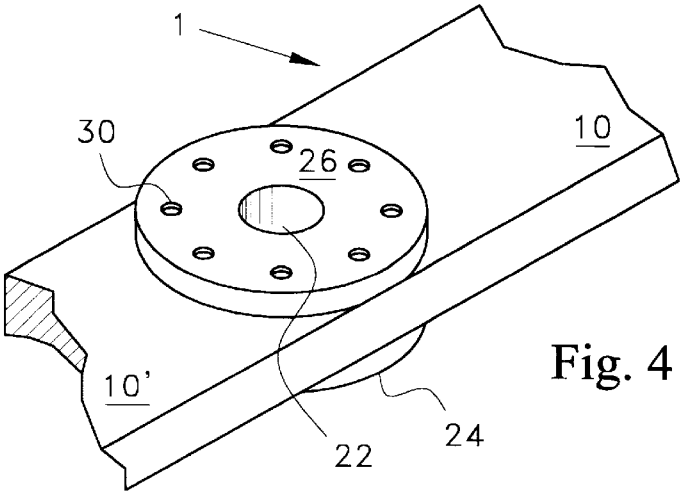

The snap clutch construction of the present invention is set forth in one preferred form in FIGS. 3 and 4, which illustrate the center portion of a wing construction for a present invention flying toy which positively provides satisfactory resistance to the force of throwing without collapse, yet collapses readily on striking a resistance. FIGS. 3 and 4 together show both sides of the same wing pieces 10 and 10' element. Wing pieces 10 and 10' are formed or joined at a center portion having raised bosses 24 and 26 and pivot hole 22. A fastener or bolt such as illustrated in FIG. 2 may be placed to securely hold together the multiple wings of the assembled device 1. In FIG. 3, raised boss or hub 24 has been formed in the flat surface of device 1 and includes eight upraised nodes or elevated elements 28. In FIG. 4, showing the other side of the same device, hub 26 has been formed in the underside flat surface of device 1 with eight recesses or pits 30. Each pit 30 is formed and is positioned and has dimensions to readily accommodate elevated elements 28 (FIG. 3) of an adjourning identical element. When the elevated elements 28 are engaged in the pits 30 of the adjacent wing piece of the assembled flying toy device, and the assembly is held together by a fastener such as a bolt, collapse of the assembled range can occur only when sufficient torque relative to two adjacent wing pieces is applied to cause all the elevated elements 28 to simultaneously become disengaged from pits 30. Other forms, quantities, styles and shapes of the nodes and pits can be generated to satisfy particular needs of the designer. For instance, where greater resistance to collapse is desired, more pairs of engaged elevated elements and recessed elements can be provided. In the alternative, the elevated elements can be made higher and the pits deeper, thereby providing greater resistance to disengagement of the elevated elements from the pits. Though the term "predetermined torque" is used in the description of the invention, it must be understood that the torque may be evaluated in practical terms, related to actual performance when throwing, and on striking a soft or hard object, rather than in numerical terms such as inch-pounds. A heavier present invention flying toy device having heavier elements requires greater strength to throw and therefore will require a greater predetermined torque to be built in to the snap clutch before collapse occurs, than a smaller lighter device.

Figure 5:
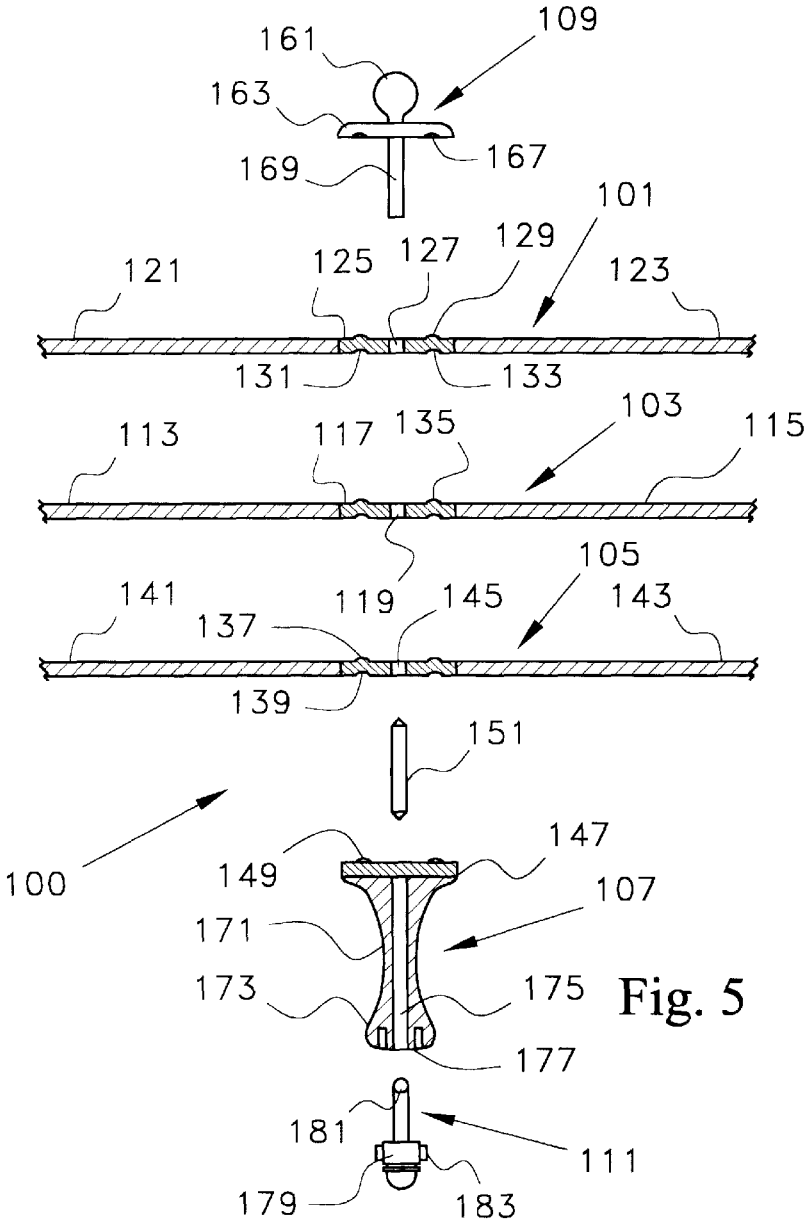
FIG. 5 shows a front exploded cut view and FIG. 6 shows an assembled view of a present invention flying toy device.
Figure 6:
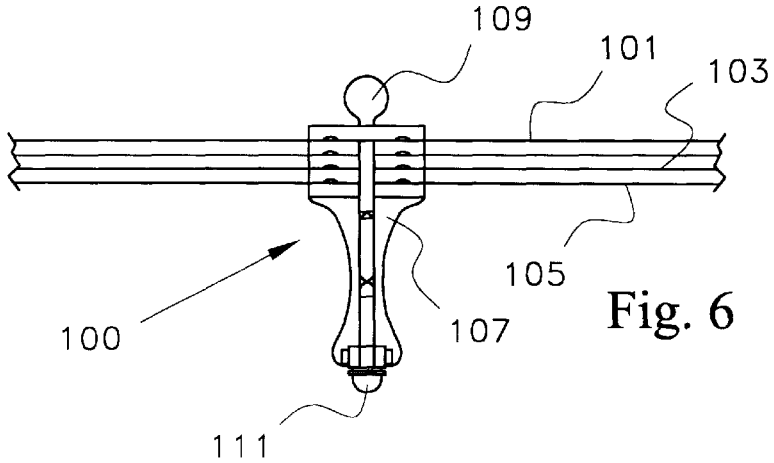

Referring now to FIGS. 5 and 6, there is shown an exploded front cut view and a front view respectively of a present invention flying toy device 100. There are a plurality of double wing pieces also referred to as wing components 101, 103 and 105. There is a handle 107, an attachment means in the form of an attachment knob 109 and an attachment plunger 111 with an elastic element 151, e.g. an elastic band. The wing components 101, 103 and 105 have center holes 127, 119 and 145 for passage therethrough of attachment knob 109. Attachment knob 109 includes a handle portion 161, a flange or wider portion 163 and recesses such as recess 167. Additionally, there is an attachment hook 169 for attachment to the top of elastic element 151. Handle 107 has a narrow central portion 171 and a wider base portion 173 and a flange 147 with protrusion elements such as 149. It also includes a hollow board central portion 175 which extends through its entire length and a wider base opening 177. Attachment plunger 111 includes a knob portion 179 and a shaft with a hook 181 for attachment to the bottom of elastic element 151. The protrusion 183 and other protrusions on knob portion 179 can be put in the first position where it is basically pulling on the elastic element 151 at an extended stretch and the second position where it has less tension. In its first position when this is assembled as shown in FIG. 6, referring to both FIGS. 5 and 6 wing components 101, 103 and 105 are maintained in a tightened, locked position whether they be opened or closed and when knob portion 179 is pulled and/or rotated to be in its second position, there is less tension on elastic element 151 (FIG. 5) and the wings may more easily be rotated so that can be placed from the opened to closed position and vice versa. Wing component 101, in addition to center hole 127 also has a hub 125 with pits 131 and 133 and protrusion element such as protrusion element 129. It also has separate wing pieces 121 and 123. Likewise, wing component 103 includes a hub 117 with pits and with protrusion elements such as protrusion element 135. It also includes separate wing pieces 113 and 115. Note that these wing pieces have a common central orifice such as orifice 119 or orifice 145 in wing component 105 and may be unistructurally molded out of plastic formed with multiple pieces such as out of wood and a light metal hub or plastic hub. Wing component 105 includes pits such as pit 139 and protrusion elements such as protrusion element 137 as well as wing pieces 141 and 143. Handle hub 147 has protrusion element such as 149 and, it should now be self-evident that the protrusion elements and pits line up with one another and interlock with one another. They operate similar in fashion to the operation described with respect to FIGS. 3 and 4 above and enable the user to arrange the wing elements so as to be, in this case, 60° apart, that is, symmetrically to achieve maximum effect. Also, it should be noted that the attachment knob 109, elastic element 151 and attachment plunger 111 operate in harmony to act as attachment means and pivoting means and at the pits and protrusion elements act as positioning means and torque resisting means.

Figure 7:
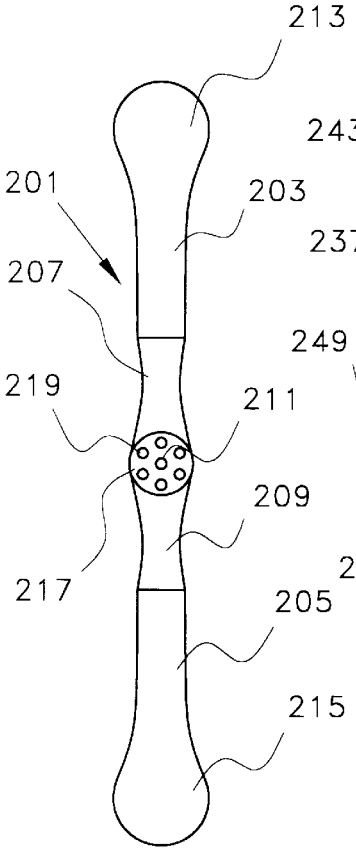
FIGS. 7 and 8 show top views of a most preferred and less preferred wing element used in the present invention flying toy devices.
Figure 8:
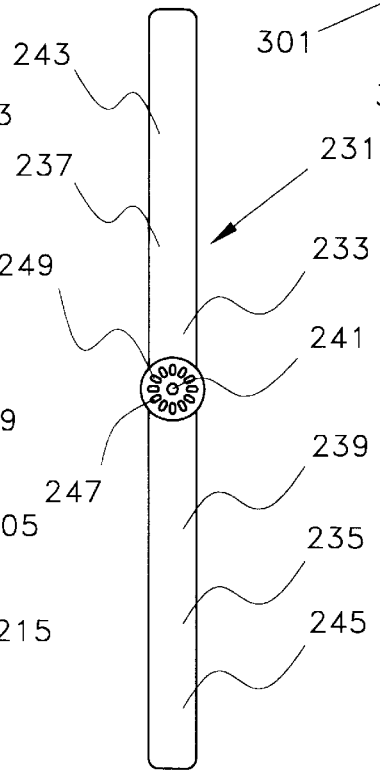

FIGS. 7 and 8 show dual wing or wing elements which may be used in the present invention and FIG. 7 shows a more preferred embodiment which optimizes the aerodynamics and increases the accuracy of the device. Wing element 201 includes a first wing piece 203 and a second wing piece 205. It has an inner portion 207 and outer portion 213 and an inner portion 209 and an outer portion 215 for wing pieces 203 and 205 respectively. There is a central orifice 211 for attachment to a handle and attachment means such as described relative to FIGS. 5 and 6 above or in conjunction with FIGS. 9 and 10 below. Protrusions such as protrusion 219 are included on hub 217 and functions similarly to those described above. Wing element 231 of FIG. 8 likewise has two wing pieces 233 and 235 and these respectively have inner portions 237 and 239 and outer portions 243 and 245 along with a central hub to 247 and central orifice 241 as such as positioning and torque resisting means such as protrusion 249.

Figure 9:
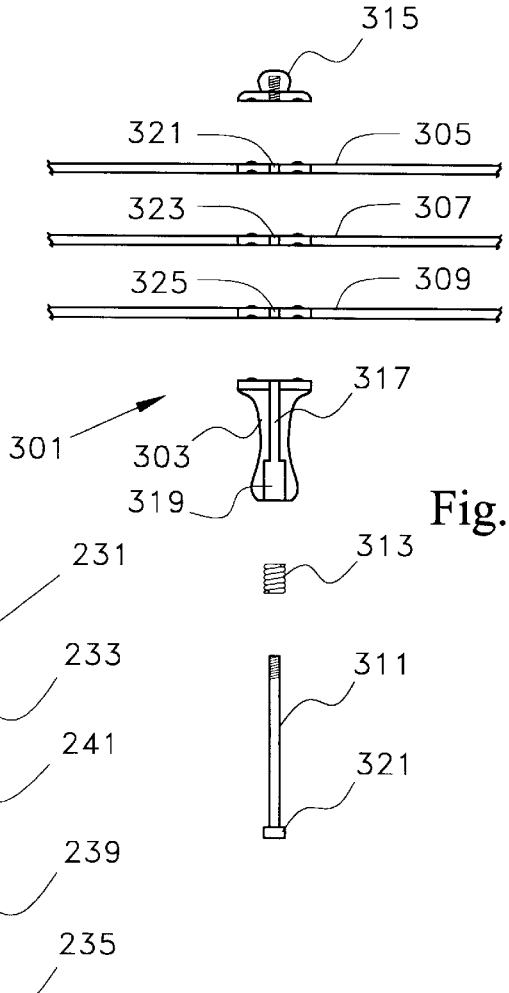
FIGS. 9 and 11 show partial front exploded views of additional alternative embodiment flying toy devices and FIGS. 10 and 12 show front views thereof, respectively.
Figure 10:
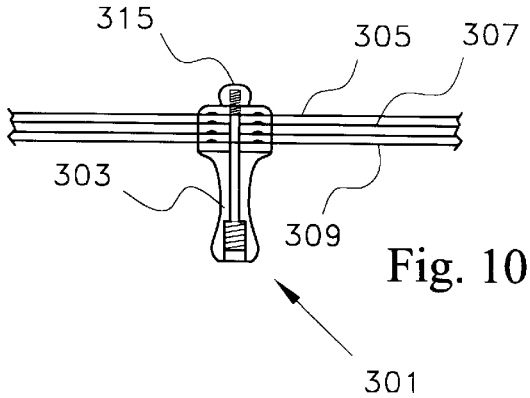

FIGS. 9 and 10, respectively, show an alternative embodiment present invention arrangement. Here, present invention toy flying device 301 includes a handle 303, wing elements 305, 307 and 309, a shaft 311, a spring 313 and an attachment knob 315. Shaft 311 and attachment knob 315 are shaped to be connectable to one another. In this case, they are threaded, but could be snap-fitted, force-fitted, glued, or otherwise attached to one another. Spring 313 maintains a tension by fitting into wider shaft opening 319 while shaft 311 extends through bore 317 for attachment to attachment knob 315. Thus, this device always has a tense position due to the spring 313 pushing down on the bottom 321 of shaft 311 which maintains wing elements 305, 307 and 309 In its more tense position. A user may simply hold the handle and push up on bottom 321 which compresses spring 313 and raises up attachment knob 315 so that wing elements 305, 307 and 309 may be moved from a first to a second position or vice versa.

Figure 11:
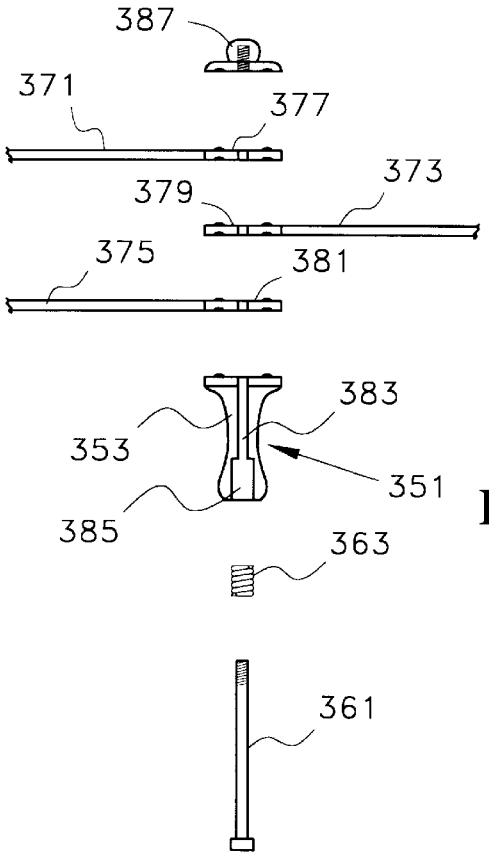
Figure 12:
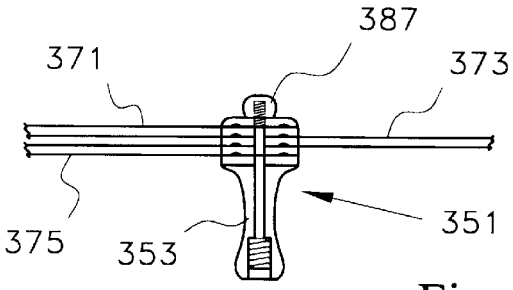

FIGS. 11 and 12 show yet a third present invention embodiment flying toy device 351 wherein wing pieces 371, 373 and 375 are utilized in conjunction with handle 353. These individual wing pieces 371, 373 and 375 are somewhat like half of those shown in FIGS. 7 and 8 and are shown in more detail in top views at FIGS. 13 and 14 which illustrate different embodiments. However, wing pieces 371, 373 and 375 have full hubs 377, 379 and 381 with orifices as shown. The attachment mechanism involves handle 353 with its bore 383 and its wider bore base portion 385 and attachment knob 387 in conjunction with spring 363 and shaft 361, by being attached together and operate in an identical fashion to the operation of the present invention device described in FIGS. 9 and 10 above.

Figure 13:
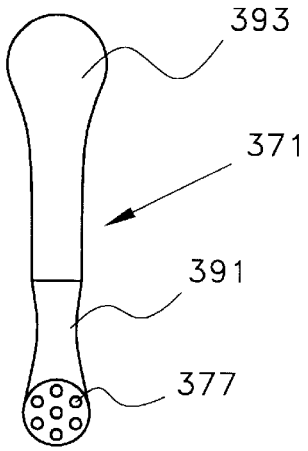
FIGS. 13 and 14 show half wing-wing elements used in the present invention flying toy devices such as is shown in FIGS. 11 and 12.
Figure 14:
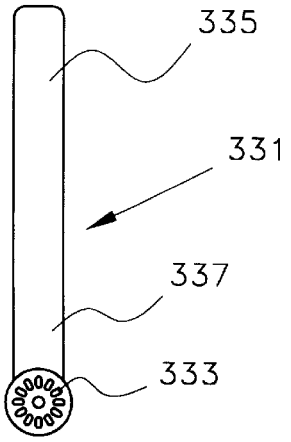

FIGS. 13 and 14 show top views of alternative embodiment wing pieces which may be utilized in the present invention devices. Specifically, FIG. 13 shows a preferred wing and FIG. 14 shows a functional wing which may be used in the present invention. FIG. 13 shows wing piece 371 and FIG. 14 shows wing piece 331. They each have hubs 377 and 333, respectively, as well as inner wing portions 391 and 337, respectively, and wing outer portions 393 and 335, respectively. It is important to note that the FIG. 13, wing piece 371 has a bulbous outer portion 393 and this has a cross sectional width which is at least 1.2 times the width of inner portion 391, whether measured in terms of the minimum and maximum widths or the average widths. For purposes of this invention, however, the multiplier of 1.2 refers to the minimum and maximum widths of the inner portion and outer portion of the wing piece respectively.

Figure 15:
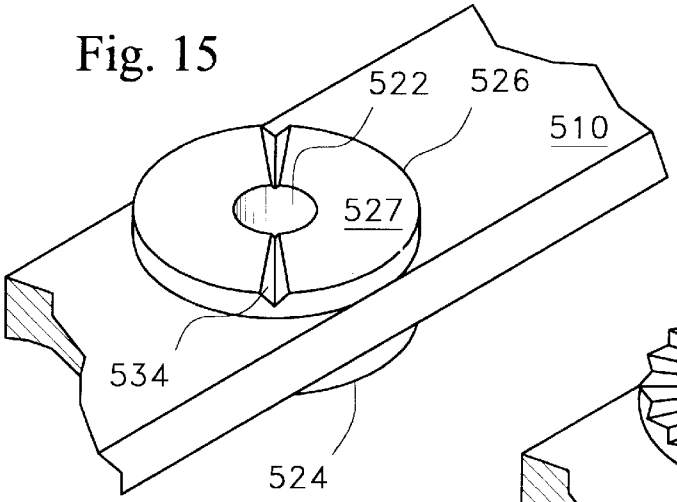
FIGS. 15 and 16 are oblique views of both sides of a central portion of a wing element of the present invention showing a second form of the snap clutch.
Figure 16:
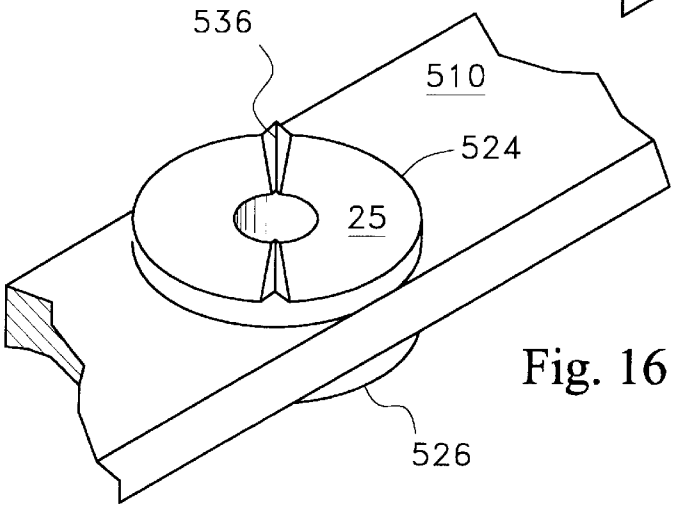

An alternative embodiment of the present invention is shown in FIGS. 15 and 16. These Figures show opposite sides of the central portion of the same wing, element 510, multiples of which are to be fastened together, via the pivot hole 522, as described. Although only two ridges and two grooves are shown in FIGS. 15 and 16, respectively, in other embodiments of the invention as few as one ridge 536 on boss 524 is combined with two or more grooves 534 in boss 526. In a further embodiment of the invention shown in FIG. 17 on wing element 610, two substantially identical bosses 638 and 642 are provided, the faces of both being provided with a radial matrix of ridges 640 of alternating ridges and grooves.

Figure 20:
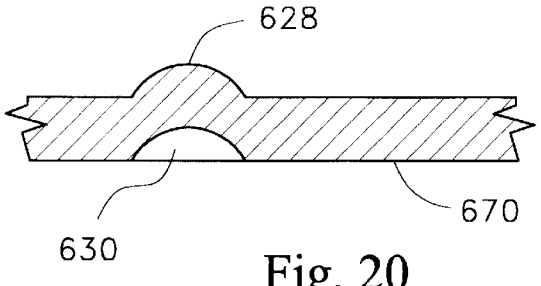
FIG. 20 is a side elevation of the cross-section of a wing element embodying a cavity and a node simultaneously formed in the wing element.
Figure 18:
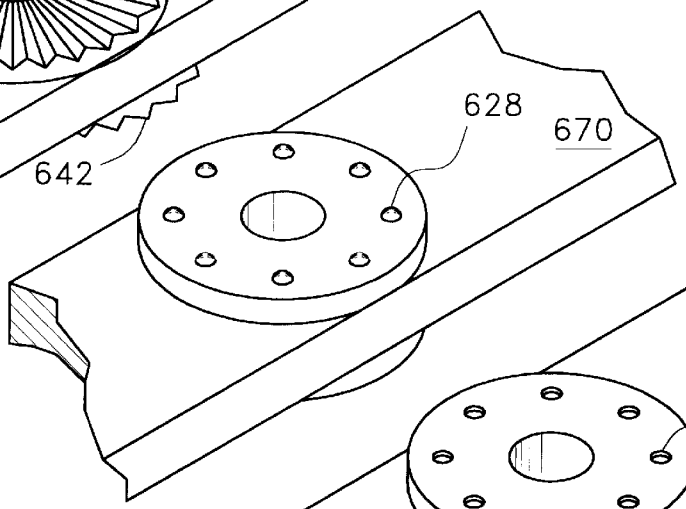
FIGS. 18 and 19 are oblique views of both sides of a flat wing embodying a snap clutch.
Figure 19:
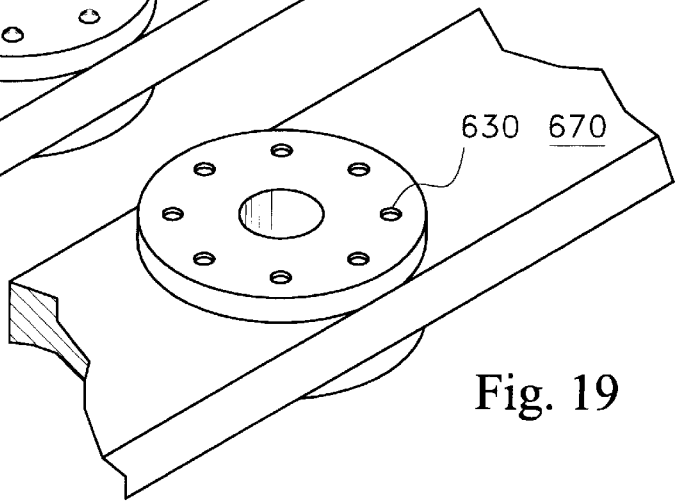
Figure 17:
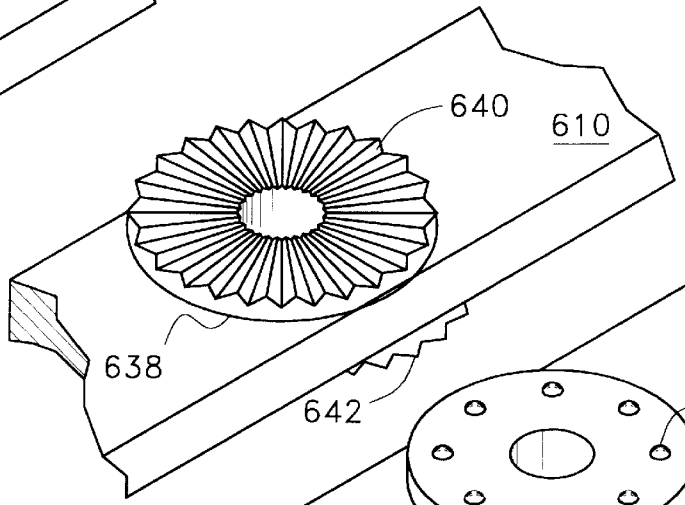
FIG. 17 shows one side of a wing exhibiting still another form of the snap clutch of the present invention.

The embodiment of the invention illustrated in FIG. 17, wing element 610 has a series of adjacent radial ridges 640 covering the faces of both the upper and lower bosses 638 and 642. In a preferred embodiment of the structure of FIG. 17, twenty four radial ridges are supplied, each being spaced fifteen radial degrees from its neighbor. With this arrangement, any two adjacent elements can be positioned in fifteen angular degree increments from its neighbor, thereby allowing the user great flexibility in the number and relative positions of the boomerang elements.

Where the material of the present invention flying toy device permits, hubs, as well as bosses are eliminated as shown in an embodiment of the invention of FIGS. 18 and 19. In FIG. 18, nodes 628 (protrusion elements) are erected from the surface of the elements which is co-planar with the surfaces of wing element 670. Likewise, in FIG. 19, pits 630 are formed in the surface of the opposite side of the element which is co-planar with the surface of wing element 670. FIG. 20 shows a side cut view of wing element 670 shown in FIGS. 18 and 19.

Figure 23:
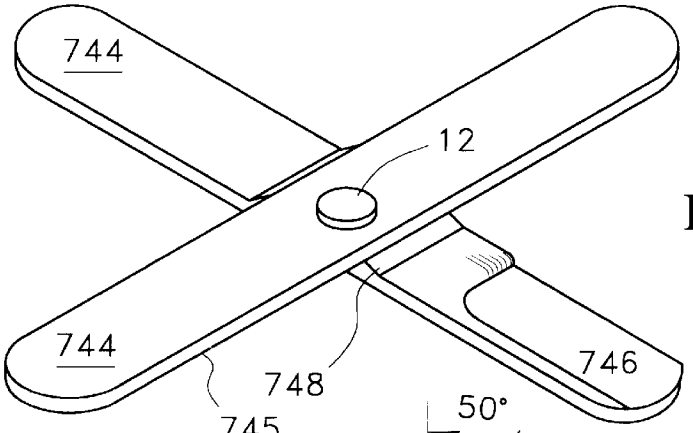
FIGS. 21, 22, 23 and 25 show views of a snap clutch having different wing elements which engage the sides of an adjacent wing only.
Figure 24:
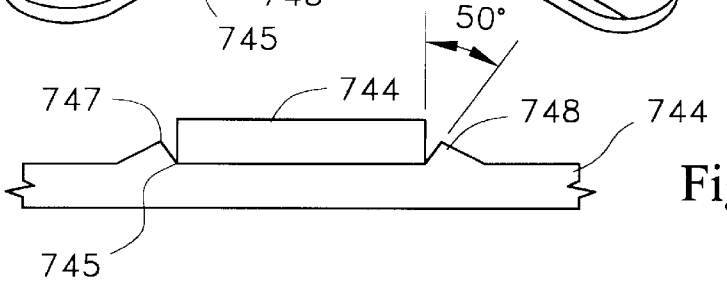
FIG. 24 is a partial view in elevation of the structure of FIGS. 21, 22 and 23.
Figure 25:
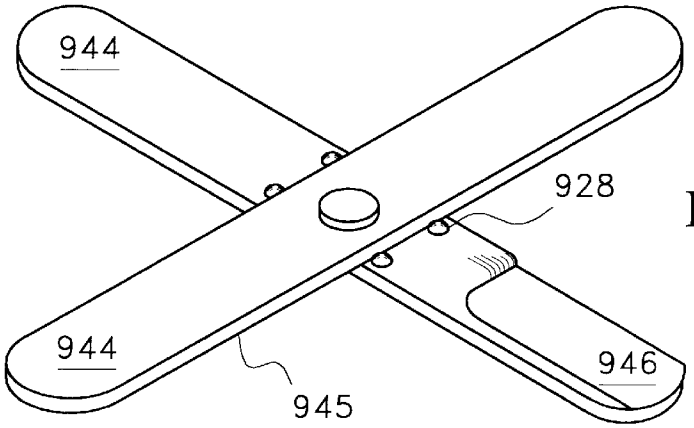
Figure 21:
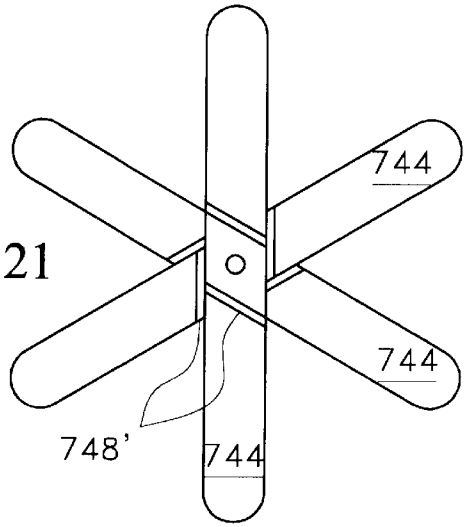
Figure 22:
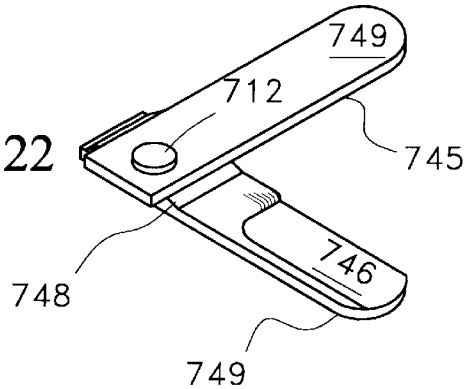

FIGS. 21, 22, 23, 24 and 25 all illustrate embodiments of present invention flying toy devices where the clutch ridges or nodes engage outer edges of an adjacent wing element. One advantage of this construction is that tooling for forming only one side of the element need be developed, the other side being smooth. Wing elements 744 and 944 are shaped with an airfoil shape 746 at each end, shown in detail in FIGS. 22, 23 and 25. In FIG. 25, nodes 928 protrude from the surface of elements 944 and engage the outer element edges 945. In FIGS. 21, 22, 23, and 24, ridges 748 which traverse the full width of the wing element 744, are produced from the element surface. Ridges 748 engage the outer edges 745 of the adjacent wing element(s) 744. In the embodiment of FIGS. 22, 23 and 24, the ridges are positioned at right angles to the long axis of the element, a construction which allows adjacent elements to be positioned only 90 radial degrees apart. The embodiment of the invention of FIG. 21 provides ridges 748' which are positioned 60 radial degrees from the long axis of the element, thereby allowing three elements 744 to be positioned to form a six wing flying toy device. Each ridge 748 is formed with a predetermined angle, e.g., an angle 50, of its inward face to the vertical as shown in FIG. 24 side view. The smaller angle 50 is made or the higher the tip 747 of ridge 748 is made, the greater the torque will be required to unclutch or collapse the adjacent elements. This is a matter of choice for the designer. A preferred design uses unfilled polyethylene to form elements. Each wing element may be, for example, 22 inches long, 1.5 inches wide and 0.125 inches thick. Ridges may be 0.060 high and angle 50 is 15 degrees.

Referring now to FIG. 22, there is shown an alternate embodiment of the invention where the structure includes the clutched central hub employing ridge 748 and pivot 712 but truncating two wings shown in FIG. 21, thereby generating two single wing elements 749. When assembled as shown in FIG. 22 there is generated an elbow shaped device having two wings, each having a wing end and a hub end. The hub end includes a snap clutch and pivot hole. The two wings are fastened together at their hub end by a pivot bolt. In this alternate construction the wings and their hubs form an elbow shaped flying toy exhibiting all the advantageous features of the invention. As described, the elbow flying toy has an angle between the wings of ninety radial degrees, though this angle is subject to change at the choice of the manufacturer or user. In the same manner a present invention flying toy device having three wings can be generated simply by providing three of the above described one-wing elements, having angular spacings as desired by the manufacturer or user.

Since greater or lesser tension can be applied via ordinary securing fasteners 20 (FIG. 2, prior art) which could traverse central pivot holes 22, to increase or decrease the declutching force or torque required to collapse the assembled boomerang, a preferred construction for the improved boomerang combines the snap clutch design with a tension limiting pivot/fastener.

Figure 26:
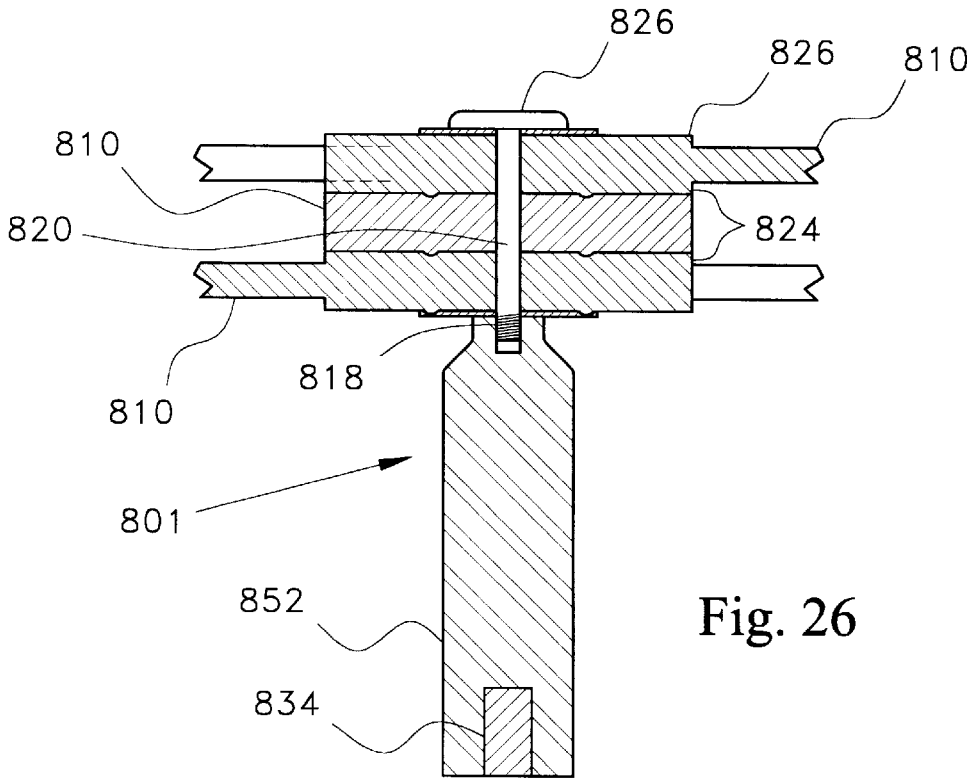
FIG. 26 is a side elevation in cross-section of an assembled present invention flying toy device, including a handle and having wings formed like those in FIGS. 3 and 4; and, FIG. 27 shows a view in partial cross-section illustrating means of applying predetermined compressive force to the assembled wings.
Figure 27:
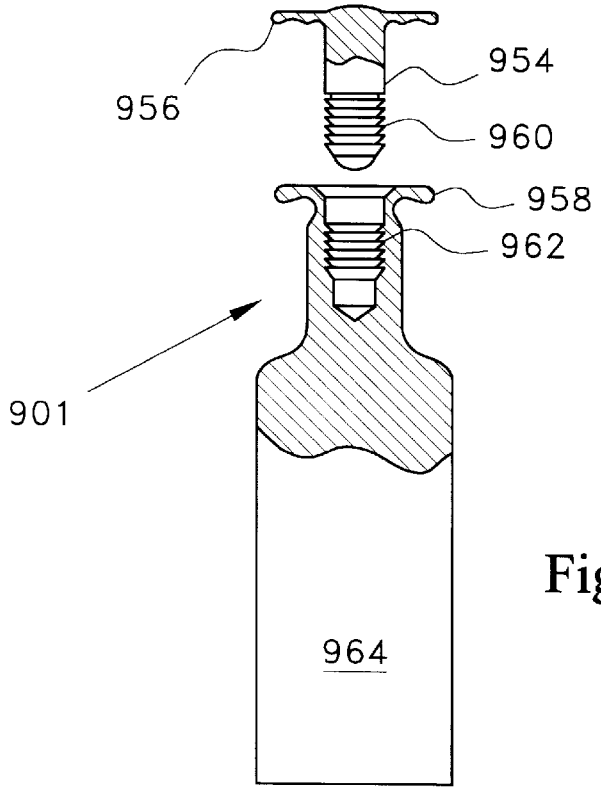

The handle 852 of present invention flying toy device 801 of FIG. 26 and handle 964 of present invention flying toy device 901 of FIG. 27 are improvements over ordinary multi-wing boomerangs having no handle or having a short handle. The handle 852, and handle 964 of FIGS. 26 and 27 all provide means for allowing the flying toy thrower, to safely catch the returning, spinning device with minimal risk of being hit by the rotating blades.

Referring again to FIG. 26, it should be noted that the present invention flying toy device 801 has a handle 852 which is much longer and thicker than conventional prior art handles and includes a weight 834 to increase the weight below the wing span. Wing elements 810 are stacked at 60° angles to one another and are interconnected by pits and nodes as described above and include thicker portions 824 constituting hubs. Attachment means 820 includes a wide top 826 and threading 818 to be threaded into handle 852. By use of this arrangement, the flight pattern of the present invention which is also achieved with the embodiments described above, is a dual flight path wherein the first portion of the path is boomerang-like, and the second flight pattern is a helicopter which spirals into the user with the wings twirling about a central axis coinciding with the center of handle 852. Likewise, in FIG. 27, present invention device 901 would have a handle 964 which is much thicker, heavier and longer than conventional handles, threading 962 and flange 958. Attachment means 954 has threading 960 to mesh with the threading of handle 964 and has a flanged area 956. When assembled, wing elements are attached between flanged area 956 and flange 958. This device would function similar to that described in conjunction with FIG. 26.

All of the embodiments described above have the dual flight pattern which has the first pattern of a boomerang and the second pattern of a spinning helicopter with the wings rotating about an axis. This creates an arc rather than a straight circular path wherein the device goes through a boomerang arc and then spirals inwardly in a helicopter fashion.

Obviously, numerous modifications and variations of the present invention are possible in light of the above teachings. It is therefore understood that within the scope of the appended claims, the invention may be practiced otherwise than as specifically described herein.

What is claimed is:

1. A multi-winged flying toy device, which comprises:

a) a handle having a predetermined shape and weight and including wing attachment means at an upper end thereof; and, b) a plurality of wings formed with at least two wing pieces, each wing piece having an inner end with a center hole for attachment to said handle via said wing attachment means, each wing piece emanating from said inner end to an outer end, each wing piece having an inner portion in proximity to said inner end, and an outer portion in proximity to said outer end;

further wherein said attachment means includes pivot means, and said wing pieces and said handle include positioning means and torque resisting means for arranging said plurality of wings in a first position, which is a closed grounded position, wherein said wing pieces are in direct alignment with one another and a second position which is an open, flyable position, wherein said wing pieces are not in direct alignment but are arranged at positions of predetermined angles relative to one another; and, further wherein said attachment means and said torque resistance means are established by said handle further having a centrally bored passage longitudinally completely therethrough said torque resistance means including a tension means to bias said wings into a chosen position, and said attachment means and said torque resistance means being moveably connected to said handle.

2. The multi-winged flying toy device of claim 1 wherein said handle has a cross section which has a center portion and a bottom portion wherein said center portion has a smaller cross sectional area than said bottom portion.

3. The multi-winged flying toy device of claim 1 wherein each wing piece is a separate component.

4. The multi-winged flying toy device of claim 1 wherein each wing piece is formed with a second wing piece which are directly opposite one another to establish a single component which is unistructurally formed.

5. The multi-winged flying toy device of claim 1 wherein said attachment means and said pivot means comprise a shaft and means for attaching said shaft to said wings and said handle.

6. The multi-winged flying toy device of claim 1 wherein said positioning means and said torque resisting means are established by a plurality of hubs with interlocking elevated elements and recessed elements located adjacent to one another relative to and located at the top of said handle and adjacent wing pieces sequentially stacked on said top of said handle.

7. The multi-winged flying toy device of claim 6 wherein said elevated elements and said recessed elements are located in a radial matrix.

8. A multi-winged flying toy device, which comprises:

a) a handle having a predetermined shape and weight and including wing attachment means at an upper end thereof; and, b) a plurality of wings formed with at least two wing pieces, each wing piece having an inner end with a center hole for attachment to said handle via said wing attachment means, each wing piece emanating from said inner end to an outer end, each wing piece having an inner portion in proximity to said inner end, and an outer portion in proximity to said outer end;

further wherein said attachment means includes pivot means, and said wing pieces and said handle include positioning means and torque resisting means for arranging said plurality of wings in a first position, which is a closed grounded position, wherein said wing pieces are in direct alignment with one another, and a second position, which is an open, flyable position, wherein said wing pieces are not in direct alignment but are arranged at positions of predetermined angles relative to one another; and, further wherein said attachment means and said torque resistance means are established by said handle further having a centrally bored passage longitudinally completely therethrough, an attachment shank entering its top and extending into said bored passage, said attachment shank having expanded width head for attaching said wing pieces to said handle, and being connected at its end opposite said head to a tension means located within said bored passage so as to maintain said head in a tensed position against said wing pieces and said handle so as to maintain said wing pieces in its first or second position, said attachment shank being releasable so as to remove tension from said wing pieces so as to permit easy movement thereof from said first to said second position and back to said first position.

9. The multi-winged flying toy device of claim 8 wherein said handle has a cross section which has a center portion and a bottom portion wherein said center portion has a smaller cross sectional area than said bottom portion.

10. The multi-winged flying toy device of claim 8 wherein each wing piece is a separate component.

11. The multi-winged flying toy device of claim 8 wherein each wing piece is formed with a second wing piece which are directly opposite one another to establish a single component which is unistructurally formed.

12. The multi-winged flying toy device of claim 8 wherein said attachment means and said pivot means comprise a shaft and means for attaching said shaft to said wings and said handle.

13. The multi-winged flying toy device of claim 8 wherein said positioning means and said torque resisting means are established by a plurality of hubs with interlocking elevated elements and recessed elements located adjacent to one another relative to and located at the top of said handle and adjacent wing pieces sequentially stacked on said top of said handle.

14. The multi-winged flying toy device of claim 13 wherein said elevated elements and said recessed elements are located in a radial matrix.

15. A multi-winged flying toy device, which comprises:

a) a handle having a predetermined shape and weight and including wing attachment means at an upper end thereof; and, b) a plurality of wings formed with at least two wing pieces, each wing piece having an inner end with a center hole for attachment to said handle via said wing attachment means, each wing piece emanating from said inner end to an outer end, each wing piece having an inner portion in proximity to said inner end, and an outer portion in proximity to said outer end, wherein said inner portion has a predetermined cross-sectional width and said outer portion has a different predetermined cross-sectional width which is at least 1.2 times wider at its widest cross-section that the predetermined width of said inner section;

further wherein said attachment means includes pivot means, and said wing pieces and said handle include positioning means and torque resisting means for arranging said plurality of wings in a first position, which is a closed grounded position, wherein said wing pieces are in direct alignment with one another, and a second position, which is an open, flyable position, wherein said wing pieces are not in direct alignment but are arranged at positions of predetermined angles relative to one another; and, further wherein said attachment means and said torque resistance means are established by said handle further having a centrally bored passage longitudinally completely therethrough, an attachment shank entering its top and extending into said bored passage, said attachment shank having expanded width head for attaching said wing pieces to said handle, and being connected at its end opposite said head to a tension means located within said bored passage so as to maintain said head in a tensed position against said wing pieces and said handle so as to maintain said wing pieces in its first or second position, said attachment shank being releasable so as to remove tension from said wing pieces so as to permit easy movement thereof from said first to said second position and back to said first position.

16. The multi-winged flying toy device of claim 15 wherein said handle has a cross section which has a center portion and a bottom portion wherein said center portion has a smaller cross sectional area than said bottom portion.

17. The multi-winged flying toy device of claim 15 wherein each wing piece is a separate component.

18. The multi-winged flying toy device of claim 15 wherein each wing piece is formed with a second wing piece which are directly opposite one another to establish a single component which is unistructurally formed.

19. The multi-winged flying toy device of claim 15 wherein said attachment means and said pivot means comprise a shaft and means for attaching said shaft to said wings and said handle.

20. The multi-winged flying toy device of claim 15 wherein said positioning means and said torque resisting means are established by a plurality of hubs with interlocking elevated elements and recessed elements located adjacent to one another relative to and located at the top of said handle and adjacent wing pieces sequentially stacked on said top of said handle.

* * * * *